US009824801B2

(12) United States Patent
Lautzenhiser

(10) Patent No.: US 9,824,801 B2
(45) Date of Patent: Nov. 21, 2017

(54) DUAL RESOLUTION POTENTIOMETER

(71) Applicant: Emhiser Research Limited, Parry Sound (CA)

(72) Inventor: Lloyd L. Lautzenhiser, Verdi, NV (US)

(73) Assignee: Emhiser Research Limited, Parry Sound (CA)

( * ) Notice: Subject to any disclaimer, the term of this patent is extended or adjusted under 35 U.S.C. 154(b) by 0 days.

(21) Appl. No.: 15/364,878

(22) Filed: Nov. 30, 2016

(65) Prior Publication Data

US 2017/0084369 A1 Mar. 23, 2017

Related U.S. Application Data

(62) Division of application No. 14/483,255, filed on Sep. 11, 2014, now Pat. No. 9,558,870.

(51) Int. Cl.

| | |
|---|---|
| ***H01C 10/18*** | (2006.01) |
| ***H01C 10/30*** | (2006.01) |
| ***H01C 10/20*** | (2006.01) |
| ***H01C 10/34*** | (2006.01) |
| ***H01C 10/32*** | (2006.01) |

(52) U.S. Cl.
CPC ..... *H01C 10/18* (2013.01); *H01C 10/20* (2013.01); *H01C 10/30* (2013.01); *H01C 10/32* (2013.01); *H01C 10/34* (2013.01)

(58) Field of Classification Search
CPC ..... H01C 10/18; H01C 10/20; H01C 10/34; H01C 10/30
See application file for complete search history.

(56) References Cited

U.S. PATENT DOCUMENTS

| | | | | |
|---|---|---|---|---|
| 3,230,491 | A | 1/1966 | Dreyfus et al. | |
| 3,676,822 | A | 7/1972 | Slagg et al. | |
| 4,238,724 | A | 12/1980 | Klaus et al. | |
| 5,084,667 | A | 1/1992 | Drori et al. | |
| 6,331,768 | B1 | 12/2001 | Drori et al. | |
| 6,552,519 | B1 | 4/2003 | Nazarian | |
| 6,555,996 | B2 | 4/2003 | Drori et al. | |
| 6,744,244 | B2 | 6/2004 | Liu et al. | |
| 6,771,053 | B2 | 8/2004 | Stanescu et al. | |
| 6,788,042 | B2 | 9/2004 | Nazarian et al. | |
| 6,882,136 | B2 | 4/2005 | Nazarian et al. | |
| 6,922,046 | B2 | 7/2005 | Liu et al. | |
| 9,558,870 | B2 * | 1/2017 | Lautzenhiser | H01C 10/18 |
| 2002/0135458 | A1 | 9/2002 | Drori et al. | |

(Continued)

OTHER PUBLICATIONS

Notification of Transmittal of the International Search Report and the Written Opinion of the International Searching Authority, or the Declaration dated Feb. 15, 2016 for International Application No. PCT/IB2015/002052 (7 pages).

*Primary Examiner* — James Harvey
(74) *Attorney, Agent, or Firm* — Taylor IP, P.C.

(57) ABSTRACT

An electrical assembly including a conductor arrangement and a dual resolution potentiometer electrically connected to the conductor arrangement. The dual resolution potentiometer includes a first resistive element having a first adjustment mechanism and a second resistive element having a second adjustment mechanism. The first adjustment mechanism being coupled in a hysteresis arrangement to the second adjustment mechanism.

14 Claims, 13 Drawing Sheets

(56) References Cited

U.S. PATENT DOCUMENTS

| | | | | |
|---|---|---|---|---|
| 2004/0196020 | A1 | 10/2004 | Liu et al. | |
| 2005/0212537 | A1 | 9/2005 | Prabhakaran et al. | |
| 2017/0084369 | A1* | 3/2017 | Lautzenhiser ..... | H01C 10/18 |

* cited by examiner

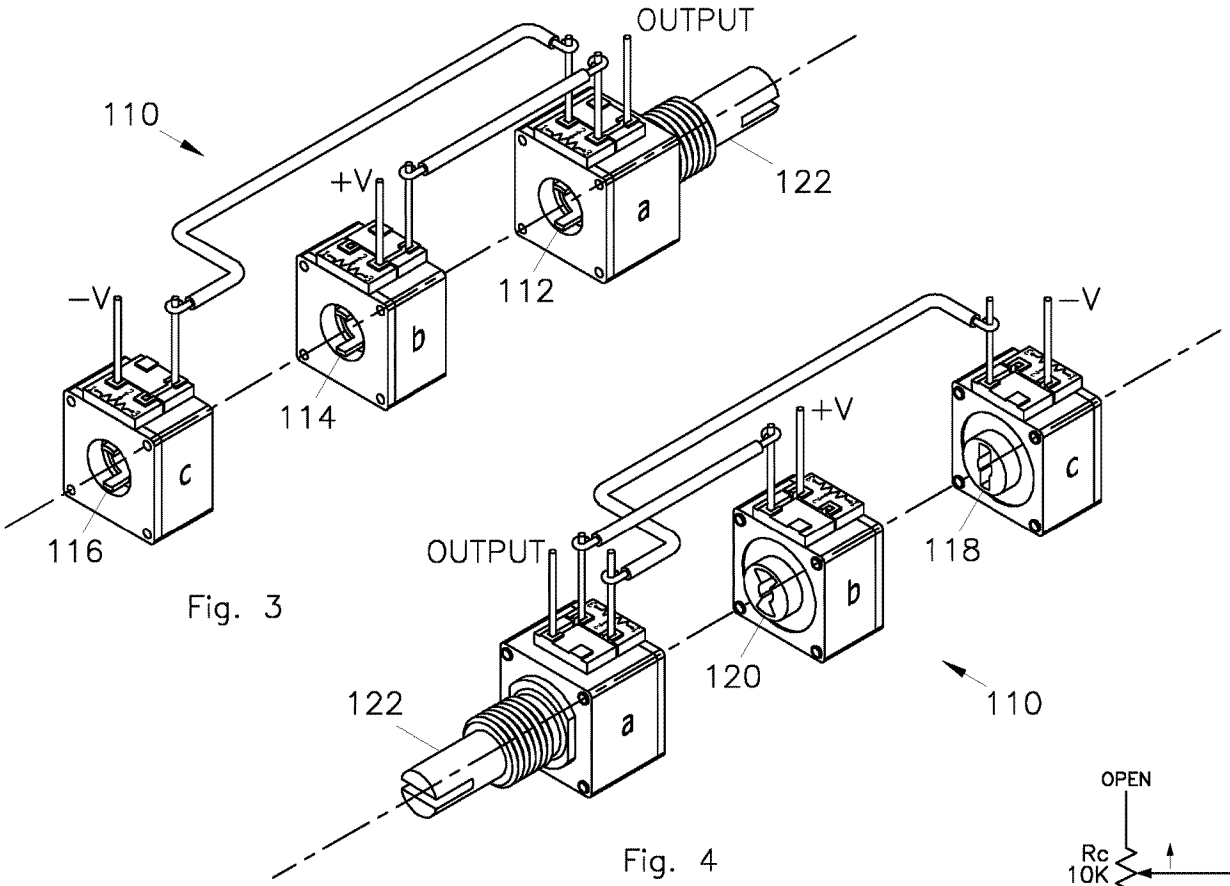
Fig. 3
Fig. 4
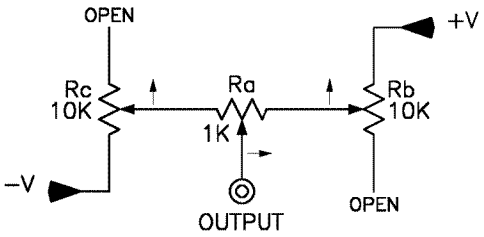
Fig. 5

MODIFIED

UNMODIFIED

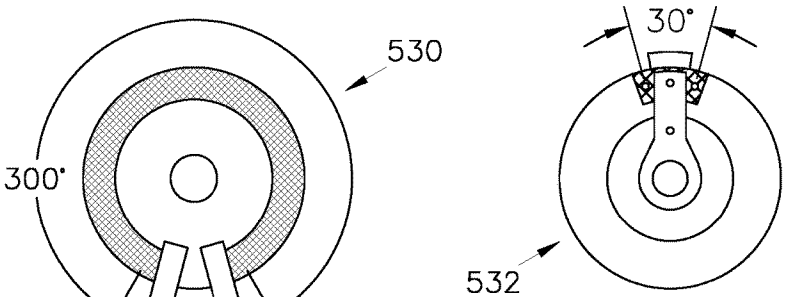
1st LAYER
Fig. 20
2nd LAYER
Fig. 21
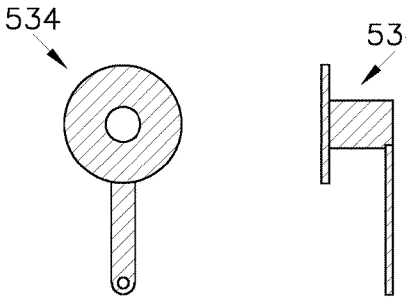
OUTPUT
3rd LAYER
Fig. 22
Fig. 23
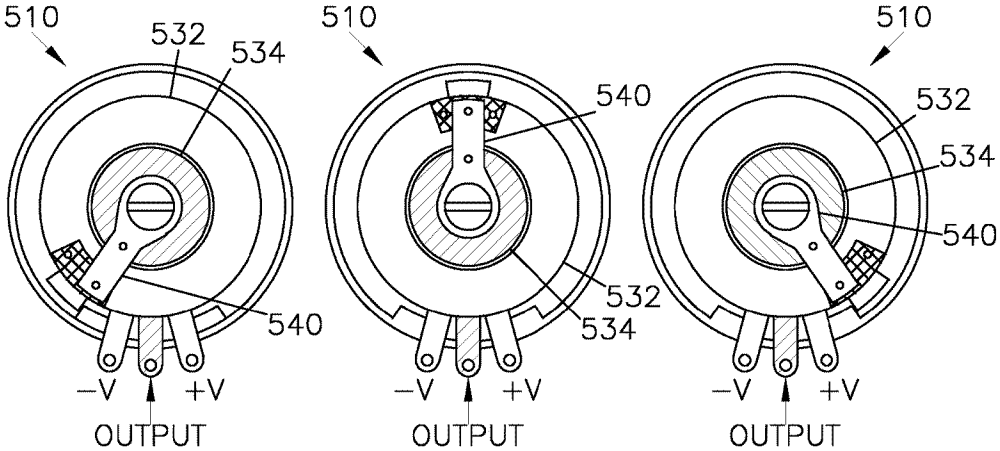
Fully CCW
Fig. 24
Mid−range
Fig. 25
Fully CW
Fig. 26
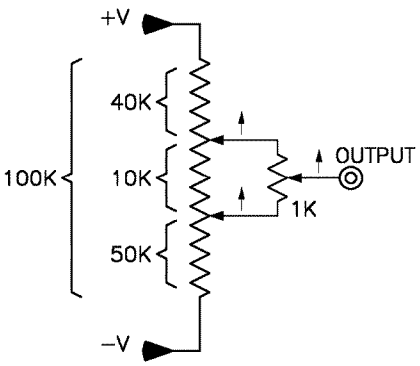
Fig. 27

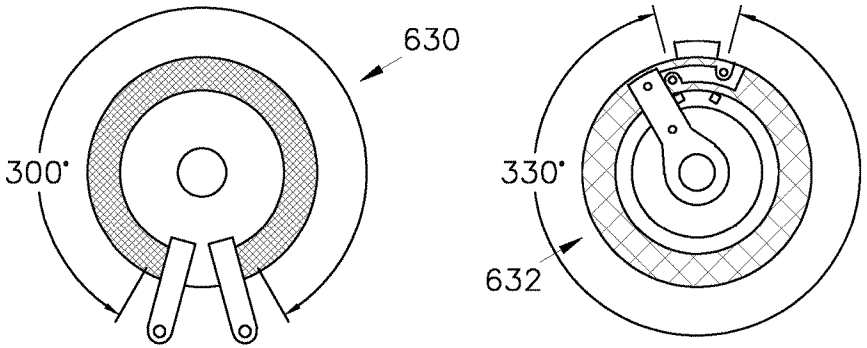
1st LAYER
Fig. 32
2nd LAYER
Fig. 33
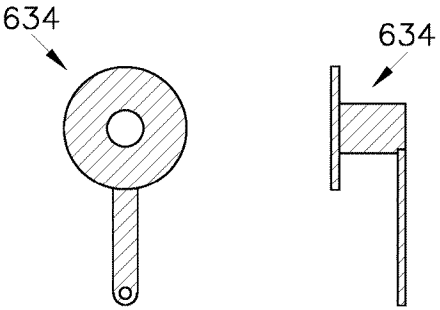
OUTPUT
3rd LAYER
Fig. 34
Fig. 35
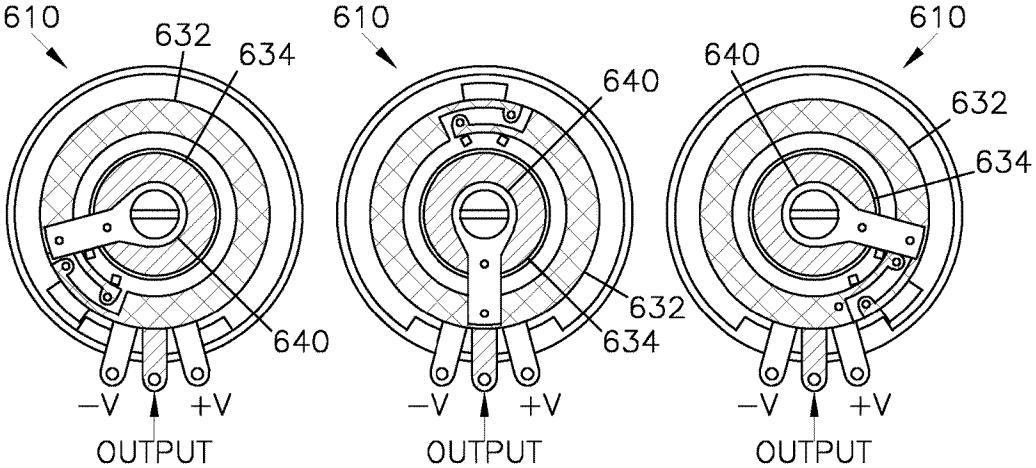
Fully CW
Fig. 38
Mid−range
Fig. 37
Fully CCW
Fig. 36
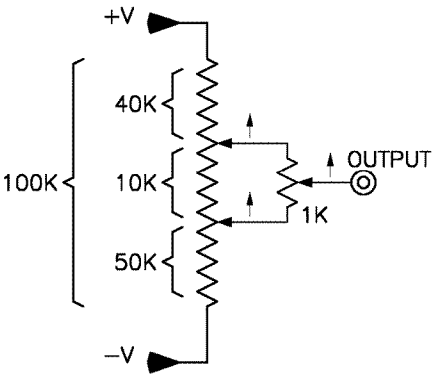
Fig. 39

DUAL RESOLUTION POTENTIOMETER

CROSS REFERENCE TO RELATED APPLICATIONS

This is a divisional of U.S. patent application Ser. No. 14/483,255, entitled "DUAL RESOLUTION POTENTIOMETER", filed, Sep. 11, 2014, which is incorporated herein by reference.

BACKGROUND OF THE INVENTION

1. Field of the Invention

The present invention relates to a potentiometer, and, more particularly, to a potentiometer with two resolutions.

2. Description of the Related Art

A resistor is a passive electrical component that exhibits electrical resistance as a circuit element. Resistors allow a current flow proportional to the voltage placed across it. Resistors may have a fixed resistance or a variable resistance—such as those found in thermistors, varistors, trimmers, photoresistors, humistors, piezoresistors, and potentiometers.

Potentiometers are common devices used in industry, often informally referred to as a "pot", and is a three-terminal resistor with a sliding contact that forms an adjustable voltage divider. If only two terminals of the potentiometer are used, one end and the wiper, it acts as a variable resistor or a rheostat.

Potentiometers are commonly used to control elements of an electrical circuit allowing their use for purposes such as volume controls on audio equipment. Potentiometers operated by a mechanism can be used as position transducers, for example, in a joystick. Potentiometers are typically used to directly control small amounts of power.

Potentiometers include a resistive element, a sliding contact, also called a wiper, that moves along the element, making good electrical contact with part of the resistive element, electrical terminals at each end of the element, a mechanism that moves the wiper from one end to the other, and a housing containing the resistive element and the wiper.

Some potentiometers are constructed with a resistive element formed into an arc of a circle usually a little less than a full turn and a wiper slides on this element when rotated, making electrical contact. The resistive element, with a terminal at each end, is flat or angled. The wiper is connected to a third terminal, usually between the other two. For single-turn potentiometers, the wiper typically travels just under one revolution as it traverses the resistive element.

Another type of potentiometer is the linear slider potentiometer, which has a wiper that slides along a linear element instead of rotating. An advantage of the slider potentiometer is that the slider position gives a visual indication of its setting.

The resistive element of potentiometers can be made of graphite, resistance wire, carbon particles in plastic, and a ceramic/metal mixture in the form of a thick film. Conductive track potentiometers use conductive polymer resistor pastes that contain hard-wearing resins and polymers, and a lubricant, in addition to the carbon that provides the conductive properties.

Potentiometers are often used within a piece of equipment and are intended to be adjusted to calibrate the equipment during manufacture or repair, and are not otherwise adjusted. They are usually physically much smaller than user-accessible potentiometers, and may need to be operated by a screwdriver rather than having a knob. They are usually called "preset potentiometers" or "trim pots". Some presets are accessible by a small screwdriver poked through a hole in the case to allow servicing without dismantling.

Multi-turn potentiometers are also operated by rotating a shaft, but by several turns rather than less than a full turn. Some multi-turn potentiometers have a linear resistive element with a sliding contact moved by a lead screw; others have a helical resistive element and a wiper that turns through 10, 20, or more complete revolutions, moving along the helix as it rotates. Multi-turn potentiometers often allow finer adjustments relative to the rotation of a rotary potentiometer.

Some potentiometers have dual resolutions with a mechanism that switches between the resolutions by some action of the operator. For example some potentiometers have a course resistance adjustment by turning a knob, then by pulling the knob to a detent position the resistance adjustment continues at a finer rate. Pressing the knob back to the original position changes the resolution back to the course position. This type of mechanism is expensive, takes up space and is subject to failure.

What is needed in the art is an easy to operate, and inexpensive to manufacture, potentiometer having dual levels of resolution.

SUMMARY OF THE INVENTION

The present invention provides a dual resolution potentiometer that changes the resolution when moved in a reverse direction.

The invention in one form is directed to an electrical assembly including a conductor arrangement and a dual resolution potentiometer electrically connected to the conductor arrangement. The dual resolution potentiometer includes a first resistive element having a first adjustment mechanism and a second resistive element having a second adjustment mechanism. The first adjustment mechanism being coupled in a hysteresis arrangement to the second adjustment mechanism.

The invention in another form is directed to a dual resolution potentiometer electrically connectable to a conductor assembly. The dual resolution potentiometer includes a first resistive element having a first adjustment mechanism and a second resistive element having a second adjustment mechanism. The first adjustment mechanism being coupled in a hysteresis arrangement to the second adjustment mechanism.

The invention in yet another form is directed to a method of altering an electrical value of an electrical component. The method includes the steps of moving an adjustment and moving the adjustment in another direction. The moving an adjustment step is directed to the adjustment of a first electrical element in a first direction. The moving step causes a second electrical element to also be moved causing the electrical value to change at a first rate. The moving the adjustment in a second direction causing the first electrical element to be adjusted apart from the second electrical element causing the electrical value to change at a second rate.

An advantage of the present invention is that the potentiometer is adjusted at two rates depending upon the direction of the adjustment.

Another advantage of the present invention is that the switching to a finer resolution does not require any action apart from the adjusting action undertaken with a courser resolution.

Yet another advantage of the present invention is that the potentiometer naturally allows for a finer adjustment after overshooting the output.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 3 is an exploded perspective view that illustrates an application of an embodiment of the present invention in the form of a manually operated electrical assembly;

FIG. 4 is another perspective view of the electrical assembly of FIG. 3;

FIG. 5 is a schematic diagram illustrating the electrical characteristics of the assembly of FIGS. 3 and 4;

FIG. 20 is an illustration of a resistive layer of the electrical assembly of FIGS. 17-19;

FIG. 21 is an illustration of another resistive layer of the electrical assembly of FIGS. 17-19;

FIG. 22 is an illustration of an output layer of the electrical assembly of FIGS. 17-19;

FIG. 23 is a side view of the output layer of FIG. 22;

FIG. 24 is a partially sectional view of the electrical assembly of FIGS. 17-19 showing an adjustment of the electrical assembly in a fully counter-clockwise position;

FIG. 25 is a partially sectional view of the electrical assembly of FIGS. 17-19 showing an adjustment of the electrical assembly in a mid-range position;

FIG. 26 is a partially sectional view of the electrical assembly of FIGS. 17-19 showing an adjustment of the electrical assembly in a fully clockwise position;

FIG. 27 is a schematic diagram illustrating the electrical characteristics of the assembly of FIGS. 17-19 and 24-26;

FIG. 32 is an illustration of a resistive layer of the electrical assembly of FIGS. 29-31;

FIG. 33 is an illustration of another resistive layer of the electrical assembly of FIGS. 29-31;

FIG. 34 is an illustration of an output layer of the electrical assembly of FIGS. 29-31;

FIG. 35 is a side view of the output layer of FIG. 34;

FIG. 36 is a partially sectional view of the electrical assembly of FIGS. 29-31 showing an adjustment of the electrical assembly in a fully counter-clockwise position;

FIG. 37 is a partially sectional view of the electrical assembly of FIGS. 29-31 showing an adjustment of the electrical assembly in a mid-range position;

FIG. 38 is a partially sectional view of the electrical assembly of FIGS. 29-31 showing an adjustment of the electrical assembly in a fully clockwise position;

FIG. 39 is a schematic diagram illustrating the electrical characteristics of the assembly of FIGS. 29-31 and 36-38;

Corresponding reference characters indicate corresponding parts throughout the several views. The exemplifications set out herein illustrate several embodiments of the invention and such exemplifications are not to be construed as limiting the scope of the invention in any manner.

DETAILED DESCRIPTION OF THE INVENTION

Figure 2:
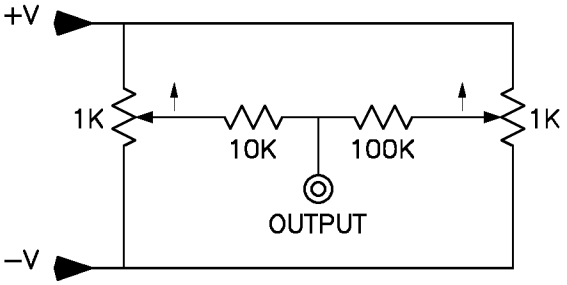
Prior Art Fig. 2
FIG. 2 illustrates in a schematical form of a prior art circuit having functioning as a potentiometer.
Figure 1:
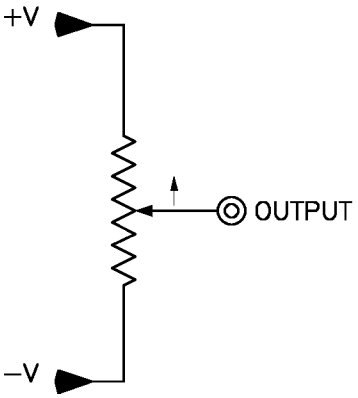
Prior Art Fig. 1
FIG. 1 illustrates the schematic diagram for a prior art potentiometer.

Referring now to the drawings, and more particularly to FIGS. 3 and 4, there is shown an embodiment of a dual resolution potentiometer 110 of the present invention in exploded views, with the elements including a potentiometer 110*a*, a potentiometer 110*b*, and a potentiometer 110*c*, and some connecting electrical conductors, such that potentiometer 110 forms a circuit such as that represented in FIG. 5. Potentiometer 110*a* has an engaging connection 112, and in a similar manner potentiometer 110*b* has an engaging connection 114 and potentiometer 110*c* has an engaging connection 116. Additionally, potentiometer 110*c* has a slotted adjustment mechanism 118, into which engaging connection 114 is inserted having little, substantially little or no slop therebetween. Potentiometer 110*b* has a slotted hysteresis adjustment mechanism 120, into which engaging connection 112 is inserted having a predefined amount of slop therebetween. An adjustment mechanism 122, which is part of potentiometer 110*a*, is configured to effect the adjustment of potentiometers 110*a-c*.

Potentiometer 110 has the characteristics illustrated in FIG. 5, wherein as adjustment mechanism 122 is rotated, say to the right (clockwise), the Output is adjusted based on the resolution of Ra until engaging connection 112 reaches the end of the range accorded in slotted hysteresis adjustment mechanism 120, then the Output is adjusted by the movement of the wipers in potentiometers 110*b* and 110*c* along resistive elements Rb and Rc. This movement along Rb and Rc affords a course adjustment along the 10K resistive elements. When the direction of rotation of adjustment mechanism 122 is reversed (in this case counter-clockwise) then the resolution is determined by the movement of the wiper of potentiometer 110*a* along the 1K resistive element of Ra, which allows for a finer adjustment of potentiometer 110. Once engaging connection 112 reaches the opposite wall of slotted hysteresis adjustment mechanism 120, then the adjustment of potentiometer 110 resumes based primarily upon the movement of the wipers associated with Rb and Rc.

Figure 7:
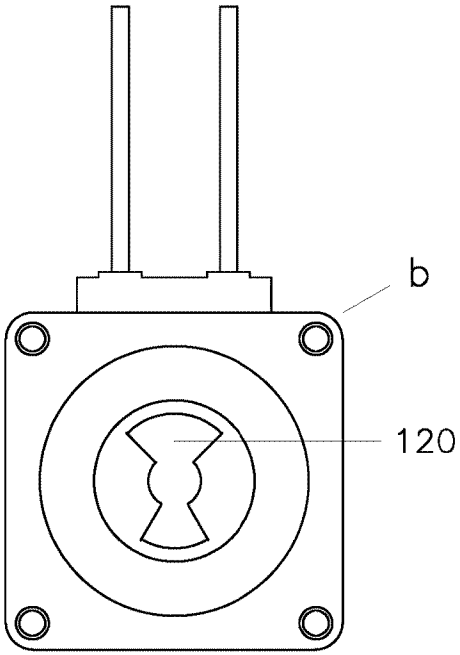
FIG. 7 is a view of another one of the electrical parts shown in FIGS. 3 and 4.
Figure 6:
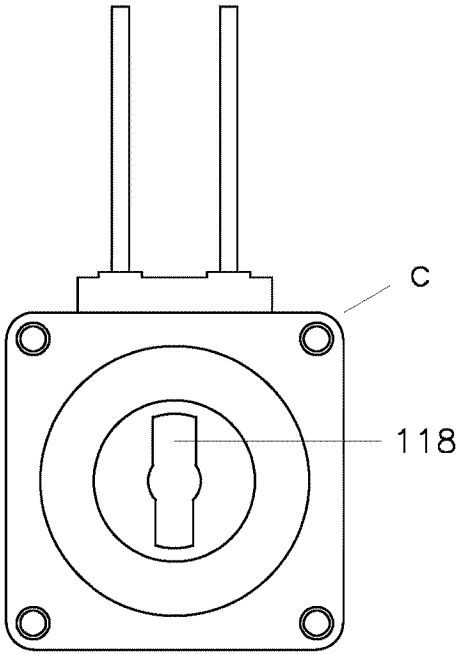
FIG. 6 is a view of one of the electrical parts shown in FIGS. 3 and 4.

Now, additionally referring to FIGS. 6 and 7, it is clearly shown the difference between slotted adjusting mechanism 118 and slotted hysteresis adjusting mechanism 120, which allows potentiometer 110*a* to be solely moved over a portion of a rotation while potentiometers 110*b* and 110*c* are unmoved. Then, as previously discussed, when the fingers of engaging connection 112 contact the walls of slot 120, potentiometers 110*b* and 110*c* are re-engaged and a course adjustment resumes.

Figure 8:
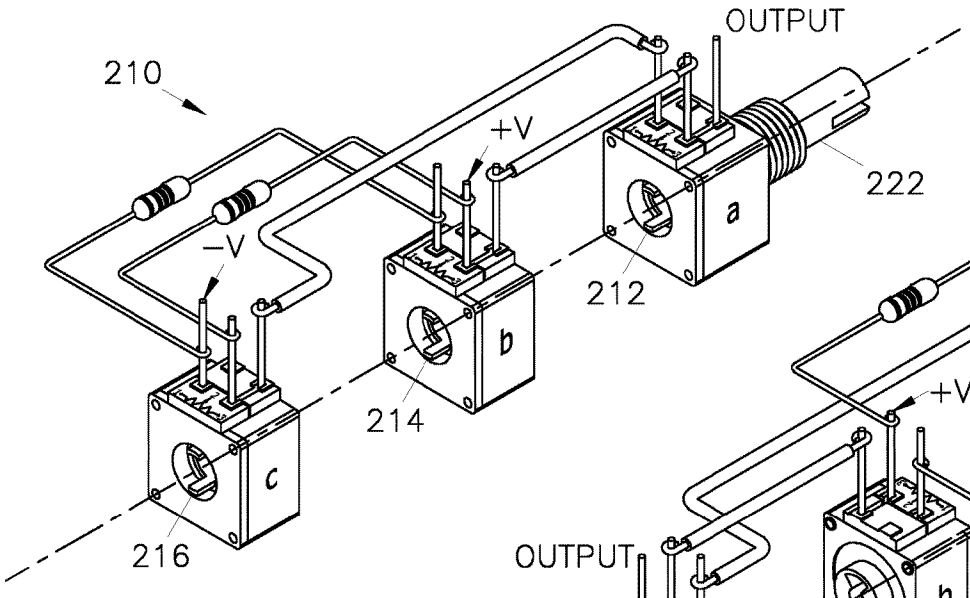
FIG. 8 is an exploded perspective view that illustrates an application of another embodiment of the present invention in the form of a manually operated electrical assembly.
Figure 9:
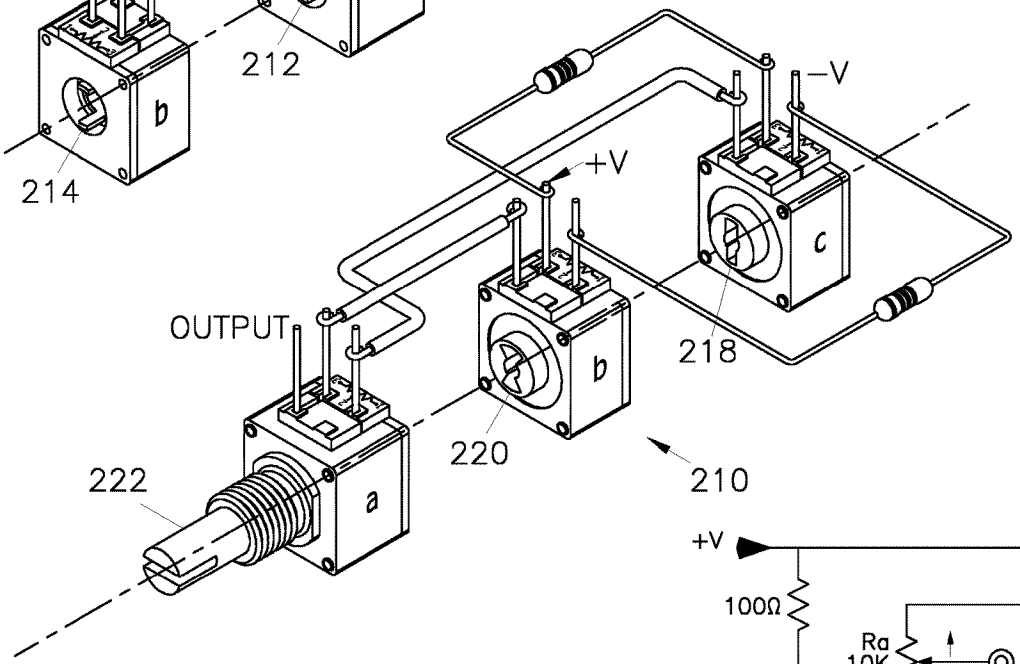
FIG. 9 is another perspective view of the electrical assembly of FIG. 8.
Figure 10:
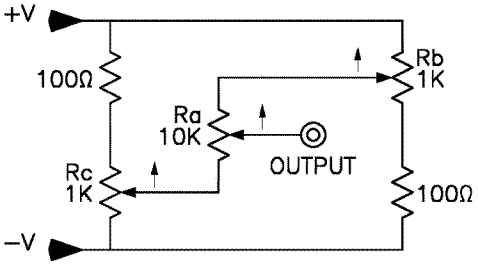
FIG. 10 is a schematic diagram illustrating the electrical characteristics of the assembly of FIGS. 8 and 9.

Now, additionally referring to FIGS. 8-10 there is shown another embodiment of the present invention, where each reference number has 100 added to the numbers used in the previously discussed embodiment. Here as in the previous embodiment as Rb and Rc are being adjusted the Output is changing at a high rate, then as adjusting mechanism 222 is reversed the adjustment of Ra takes place, which changes the output at a reduced rate, largely based on the values of the fixed resistors that provide offsetting voltages in the two legs of the circuit.

Figure 11:
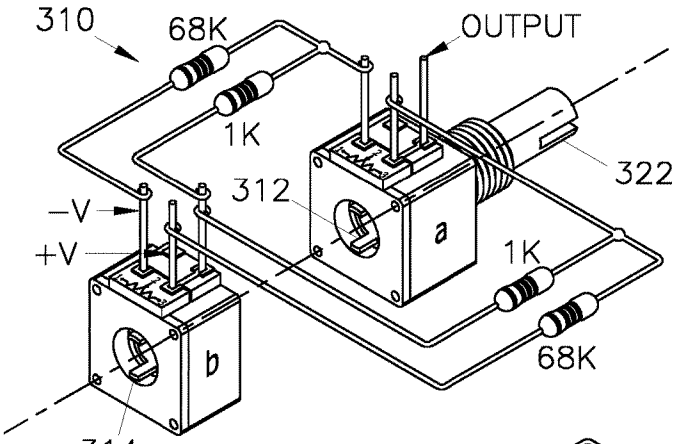
FIG. 11 is an exploded perspective view that illustrates an application of yet another embodiment of the present invention in the form of a manually operated electrical assembly.
Figure 12:
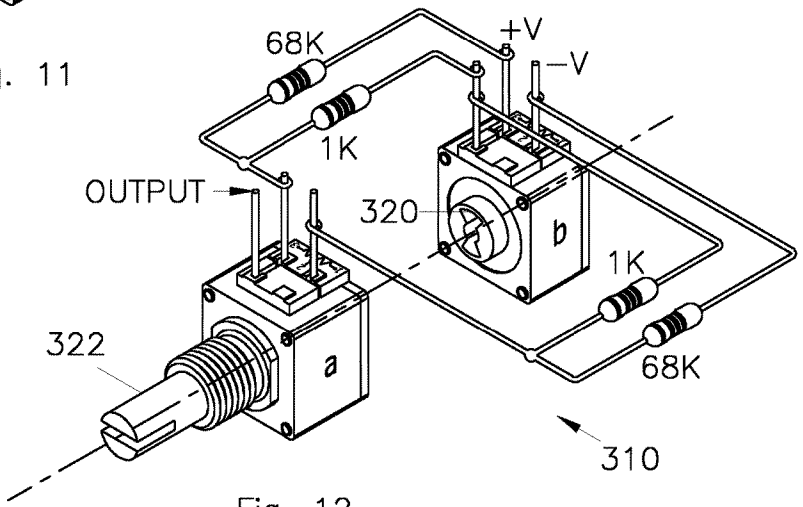
FIG. 12 is another perspective view of the electrical assembly of FIG. 11.
Figure 13:
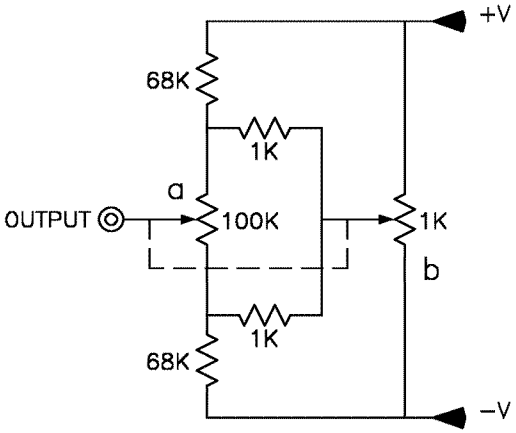
FIG. 13 is a schematic diagram illustrating the electrical characteristics of the assembly of FIGS. 11 and 12.

Now, additionally referring to FIGS. 11-13 there is shown another embodiment of the present invention, where each reference number has 100 added to the numbers used in the previously discussed embodiment. Here again when potentiometer 310*b* is being adjusted the Output is changing at a faster rate than when adjusting mechanism 322 is just adjusting potentiometer 310*a* when engaging connection 312 is operating in the hysteresis zone between the walls of slot 320. An advantage of this embodiment of the present invention is that it only requires the use of two potentiometers. This configuration unlike some of the others presented herein, will not allow an adjustment to completely reach the two voltage extremes. This is not necessarily a disadvantage because in some applications it is an advantage to avoid such an adjustment.

Figure 14:
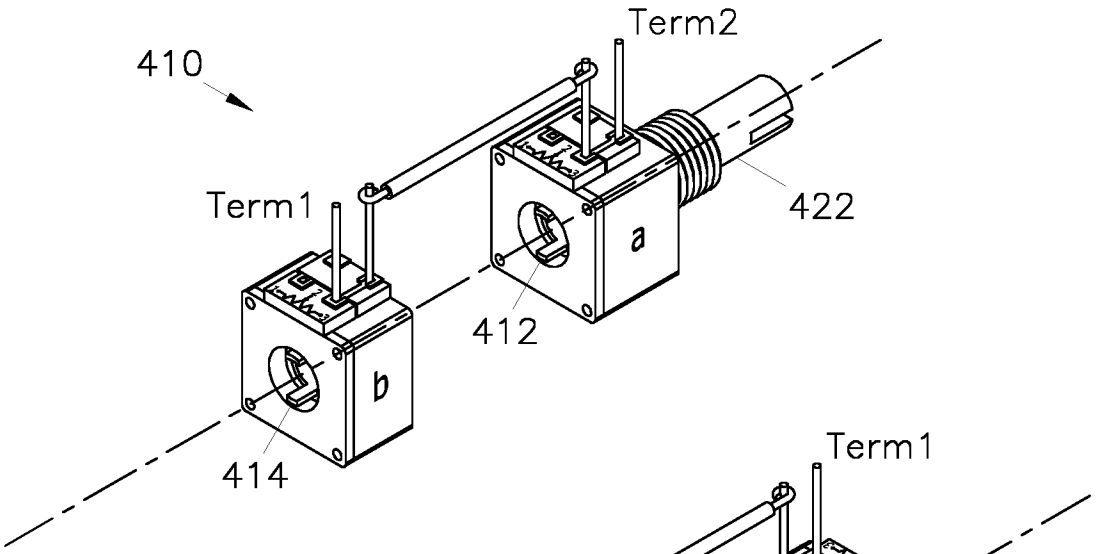
FIG. 14 is an exploded perspective view that illustrates an application of yet still another embodiment of the present invention in the form of a manually operated electrical assembly.
Figure 15:
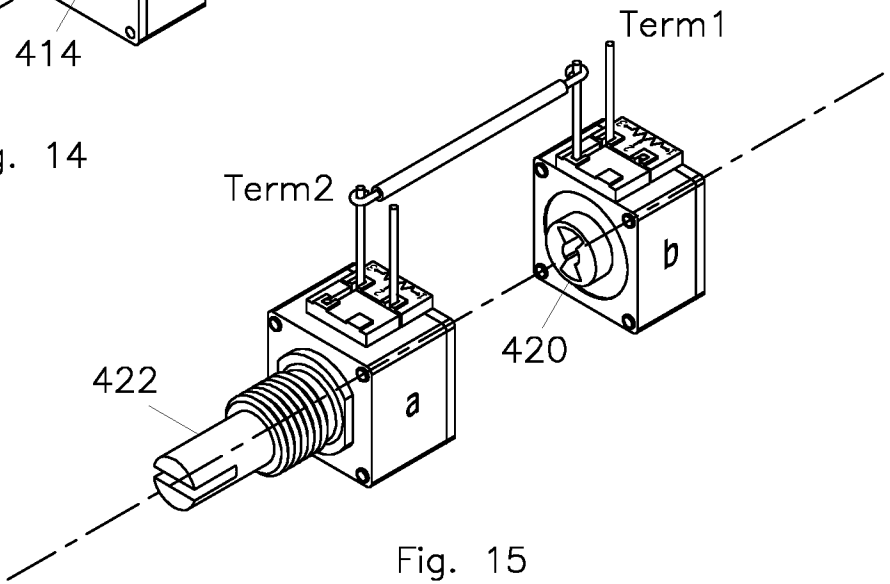
FIG. 15 is another perspective view of the electrical assembly of FIG. 14.
Figure 16:
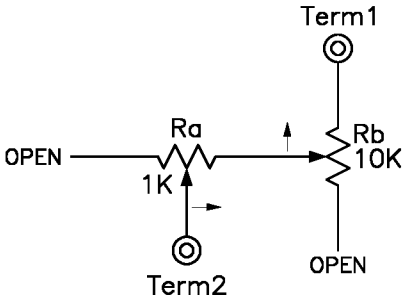
FIG. 16 is a schematic diagram illustrating the electrical characteristics of the assembly of FIGS. 14 and 15.
Figure 19:
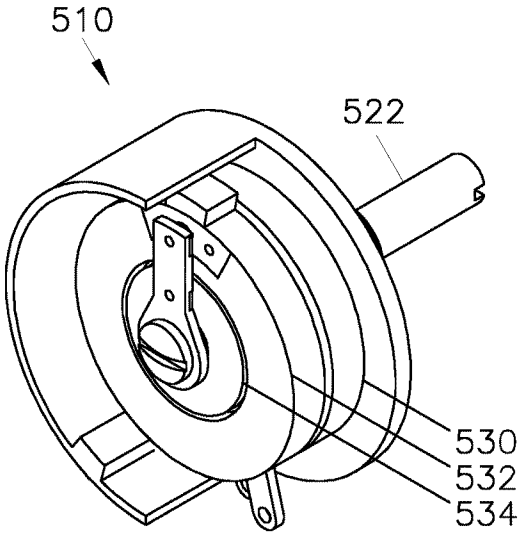
FIG. 19 is a cutaway perspective view of the electrical assembly of FIGS. 17 and 18.
Figure 18:
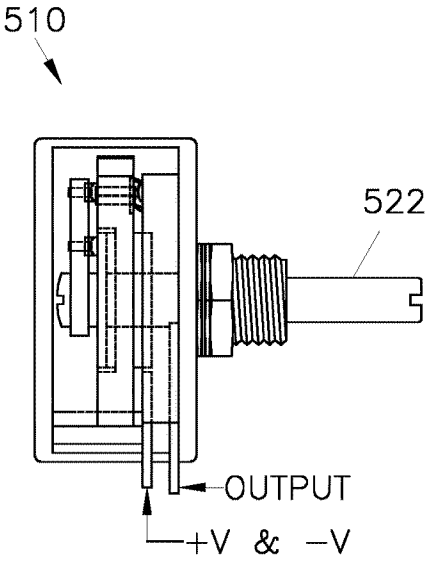
FIG. 18 is a cutaway side view of the electrical assembly of FIG. 17.
Figure 17:
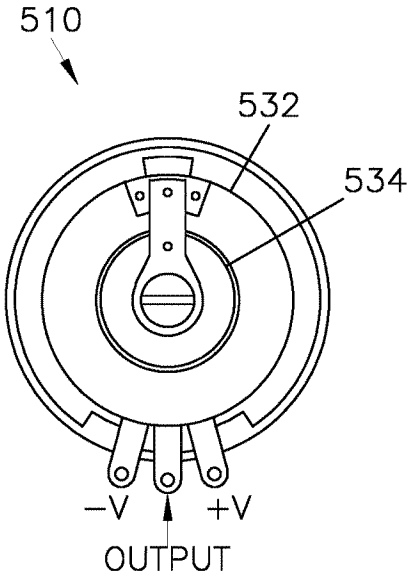
FIG. 17 is a cutaway view of yet another embodiment of the present invention in the form of a manually operated electrical assembly.
Figure 28:
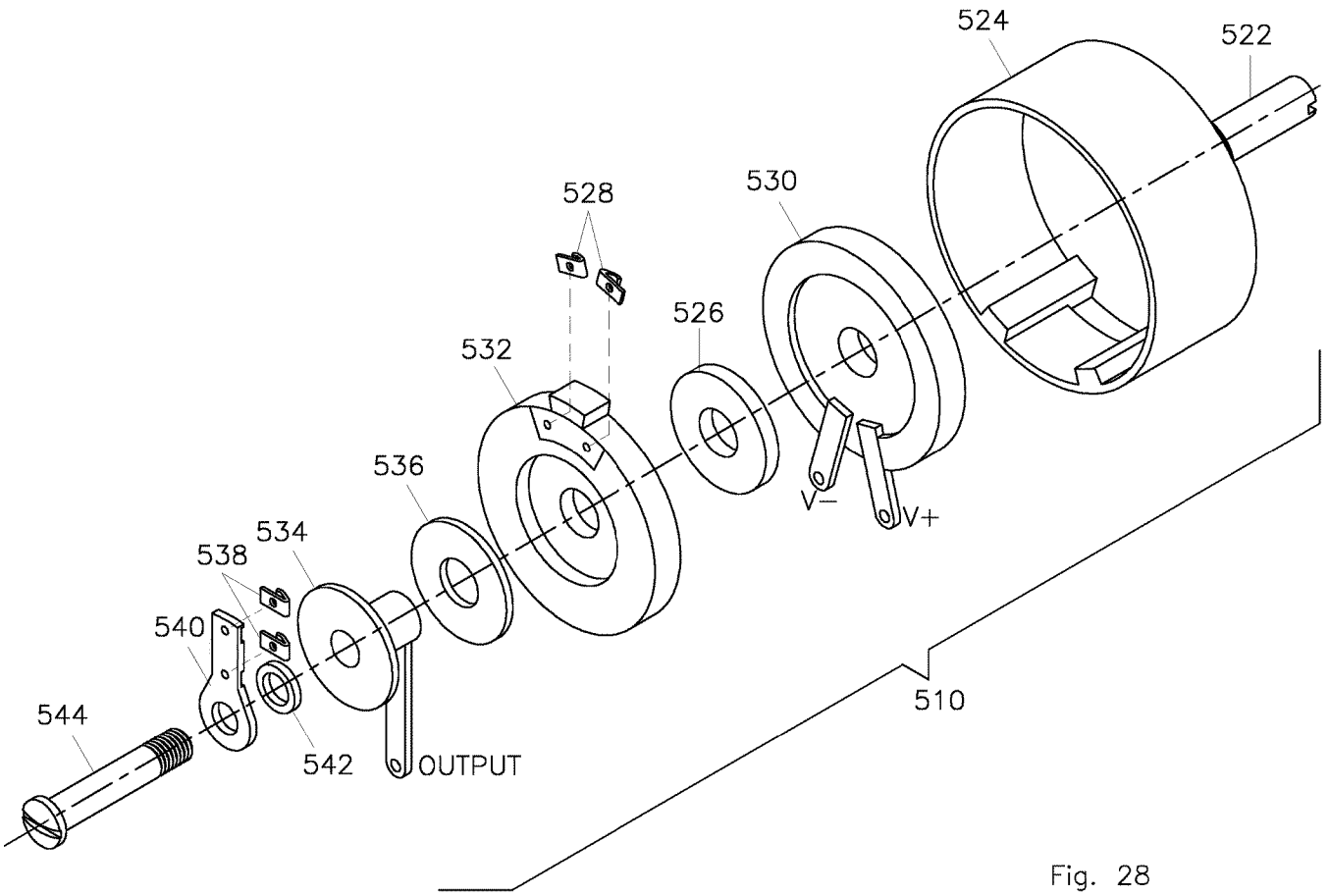
FIG. 28 is an exploded view of the electrical assembly of FIGS. 17-19 and 24-27.
Figure 31:
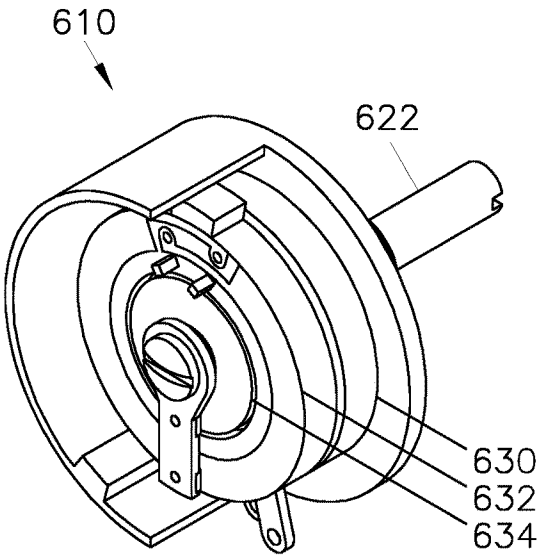
FIG. 31 is a cutaway perspective view of the electrical assembly of FIGS. 29 and 30.
Figure 30:
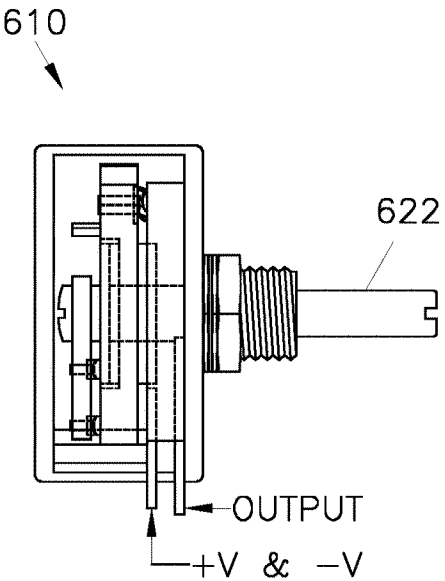
FIG. 30 is a cutaway side view of the electrical assembly of FIG. 29.
Figure 29:
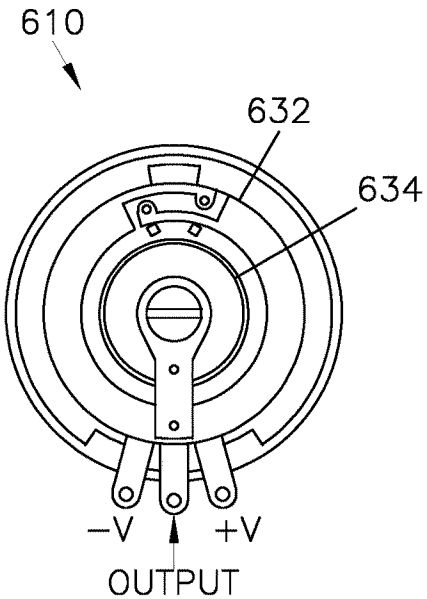
FIG. 29 is a cutaway view of yet another embodiment of the present invention in the form of a manually operated electrical assembly.
Figure 40:
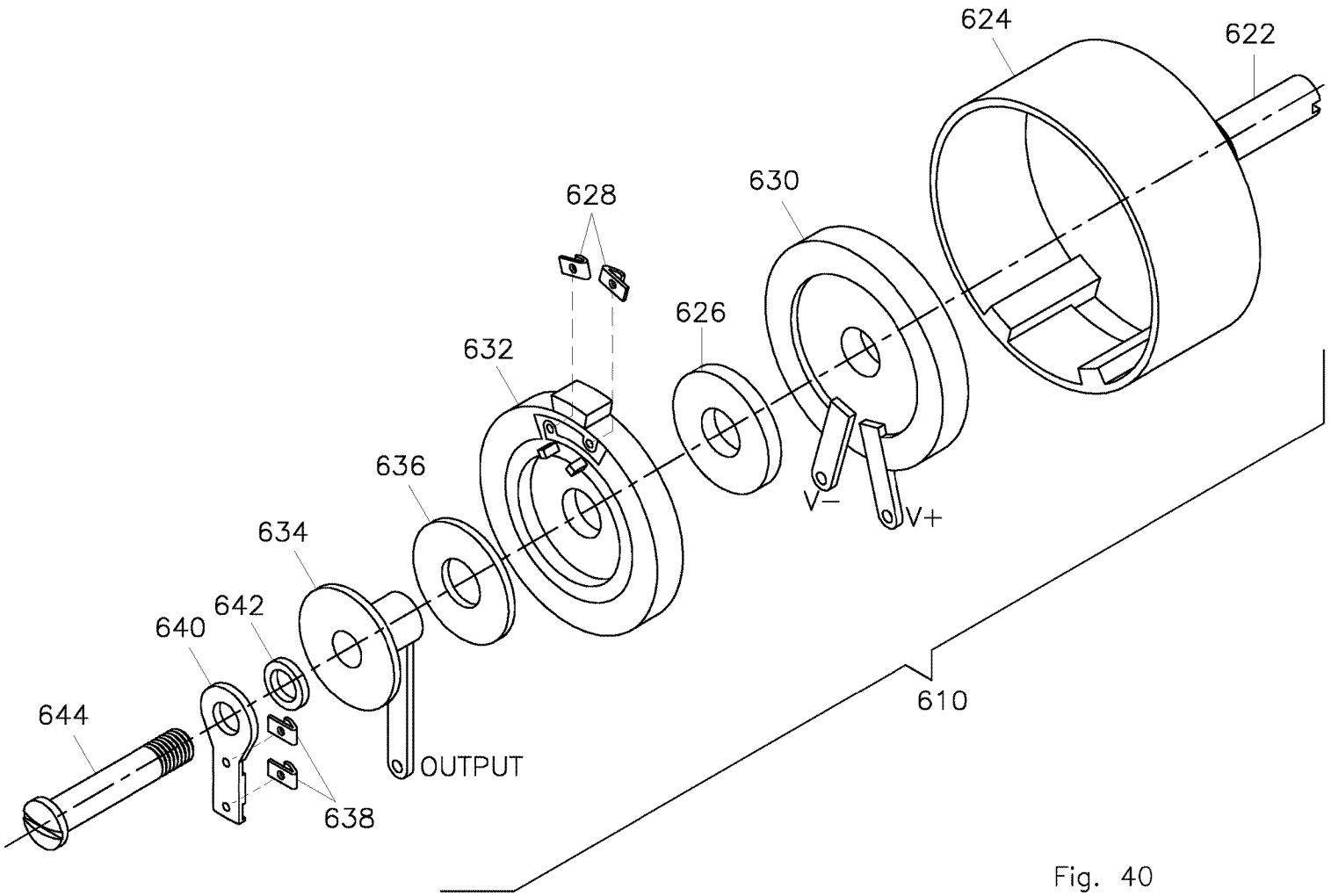
FIG. 40 is an exploded view of the electrical assembly of FIGS. 29-31 and 36-39.

Now, additionally referring to FIGS. 14-16 there is shown another embodiment of the present invention, where each reference number has 100 added to the numbers used in the previously discussed embodiment. Here again when potentiometer 410*b* is being adjusted the Output is changing at a faster rate than when adjusting mechanism 422 is just adjusting potentiometer 410*a* when engaging connection 412 is operating in the hysteresis zone between the walls of slot 420. In this configuration the two potentiometers are function as rheostats and are wired overall to work as a rheostat, but with the feature of dual adjustability of the present invention. When adjusting mechanism 422 is turned and Rb is being adjusted the adjustment is of the 10 Kohm resistance element, then when a reverse motion is made to adjusting mechanism 422 the adjustment is to Ra, which is along a 1 Kohm resistance element allowing a finer more precise adjustment of the overall resistance value.

Now, additionally referring to FIGS. 17-28 there is shown various views of another embodiment of the present invention, which electrically behaves as illustrated in the schematic of FIG. 27. The values shown here and in the other figures are for illustrative purposes and the actual values used in any embodiment can be chosen to meet the needs of the particular application. Here a first resistive layer 530 and a second resistive layer 532, as well as a third layer 534 interact to provide the features for dual resolution potentiometer 510.

A washer 526 is positioned on a bolt 544 between layers 530 and 532. Wipers 528 are connected to one side of resistive layer 532 and are in wiping electrical contact with resistive layer 530, the positioning of wipers 528 provide for a resistive element therebetween on resistive layer 530, which is illustrated as 10 Kohms in FIG. 27. Resistive layer 532 is illustrated as having approximately a 30° range as shown in FIG. 21. A washer 536 is shown as being between layer 534 and layer 532. Wipers 538 are installed on wiper assembly 540, and a washer 542 is positioned between layer 534 and wiper assembly 540. As wiper assembly 540 is rotated by movement of adjustment mechanism 522, one wiper 538 moves on output layer 534, which can be thought of as a conductor, and the other wiper 538 moves along the surface of resistive layer 532 to vary the 1 K resistor of FIG. 27, which is the fine resolution part of the movement of adjustment mechanism 522. When wiper assembly 540 reaches the end of the range, in this example the 30° range, then wiper assembly 540 encounters a protrusion that causes resistive layer 532 to rotate and wipers 528 to move along the surface of resistive layer 530, which is seen in FIG. 27 as the movement of the 1K resistor along the 100 Kohm element, which is the coarse adjustment. Note that the 40K and 50K only represent one position of wipers 528 and the values change as adjustment mechanism 522 is rotated. To revert to the fine adjustment mode adjustment mechanism 522 is reversed in direction and wipers 538 traverse, for 30°, the 1K resistor. When adjustment mechanism 522 reaches a protrusion on the other end of the 30° movement then the adjustment is then again in the coarse mode.

Now, additionally referring to FIGS. 29-40 there is shown various views of yet another embodiment of the present invention, which electrically behaves as illustrated in the schematic of FIG. 39. The values shown here and in the other figures are for illustrative purposes and the actual values used in any embodiment can be chosen to meet the needs of the particular application. Here a first resistive layer 630 and a second resistive layer 632, as well as a third layer 634 interact to provide the features for dual resolution potentiometer 610.

A washer 626 is positioned on a bolt 644 between layers 630 and 632. Wipers 628 are connected to one side of resistive layer 632 and are in wiping electrical contact with resistive layer 630, the positioning of wipers 628 provide for a resistive element therebetween on resistive layer 630, which is illustrated as 10 Kohms in FIG. 39. Resistive layer 632 is illustrated as having approximately a 330° range as shown in FIG. 33. A washer 636 is shown as being between layer 634 and layer 632. Wipers 638 are installed on wiper assembly 640, and a washer 642 is positioned between layer 634 and wiper assembly 640. As wiper assembly 640 is rotated by movement of adjustment mechanism 622, one wiper 638 moves on output layer 634, which can be thought of as a conductor, and the other wiper 638 moves along the surface of resistive layer 632 to vary the 1 K resistor of FIG. 39, which is the fine resolution part of the movement of adjustment mechanism 622, which extends for 330°, or some other predefined angle. When wiper assembly 640 reaches the end of the range, in this example the 330° range, then wiper assembly 640 encounters a protrusion that causes resistive layer 632 to rotate and wipers 628 to move along the surface of resistive layer 630, which is seen in FIG. 39 as the movement of the 1K resistor along the 100 Kohm element, which is the coarse adjustment. Note that the 40K and 50K only represent one position of wipers 628 and the values change as adjustment mechanism 622 is rotated. To revert to the fine adjustment mode adjustment mechanism 622 is reversed in direction and wipers 638 traverse, for 330°, the 1K resistor. When adjustment mechanism 622 reaches a protrusion on the other end of the 330° movement then the adjustment is then again in the coarse mode.

As a comparison of the two previous embodiments of the present invention, assuming, for the sake of discussion, that 100 V is applied from the +V terminal to the −V terminal, then approximately 1 V exists across the 1 Kohm resistance element. As the wipers 538 and 638 respectively move across resistance layers 532 and 632 they both adjust the output over the approximate 1 volt range of adjustability. The difference being that in the first embodiment, of these two, the adjustability occurs over 30°, and in the second the adjustability is over 330°. As a result the adjustment in the first will result in approximately 33 mV per degree of rotation (1V/30°) and the second will result in approximately 3 mV per degree of rotation (1V/330°). This highlights the significant advantages of the present invention in that a fast coarse adjustment can be made by turning adjustment mechanisms 122, 222, 322, 422, 522 and 622, then when reversing directions a fine adjustment is available. This type of adjustment is even intuitive, because often, when adjusting a voltage level (or some observable result controlled by the voltage level) it is not unusual to overshoot the intended output, then with the present invention the reverse motion automatically becomes a fine adjustment allowing the desired output to be easily selected.

Figure 41:
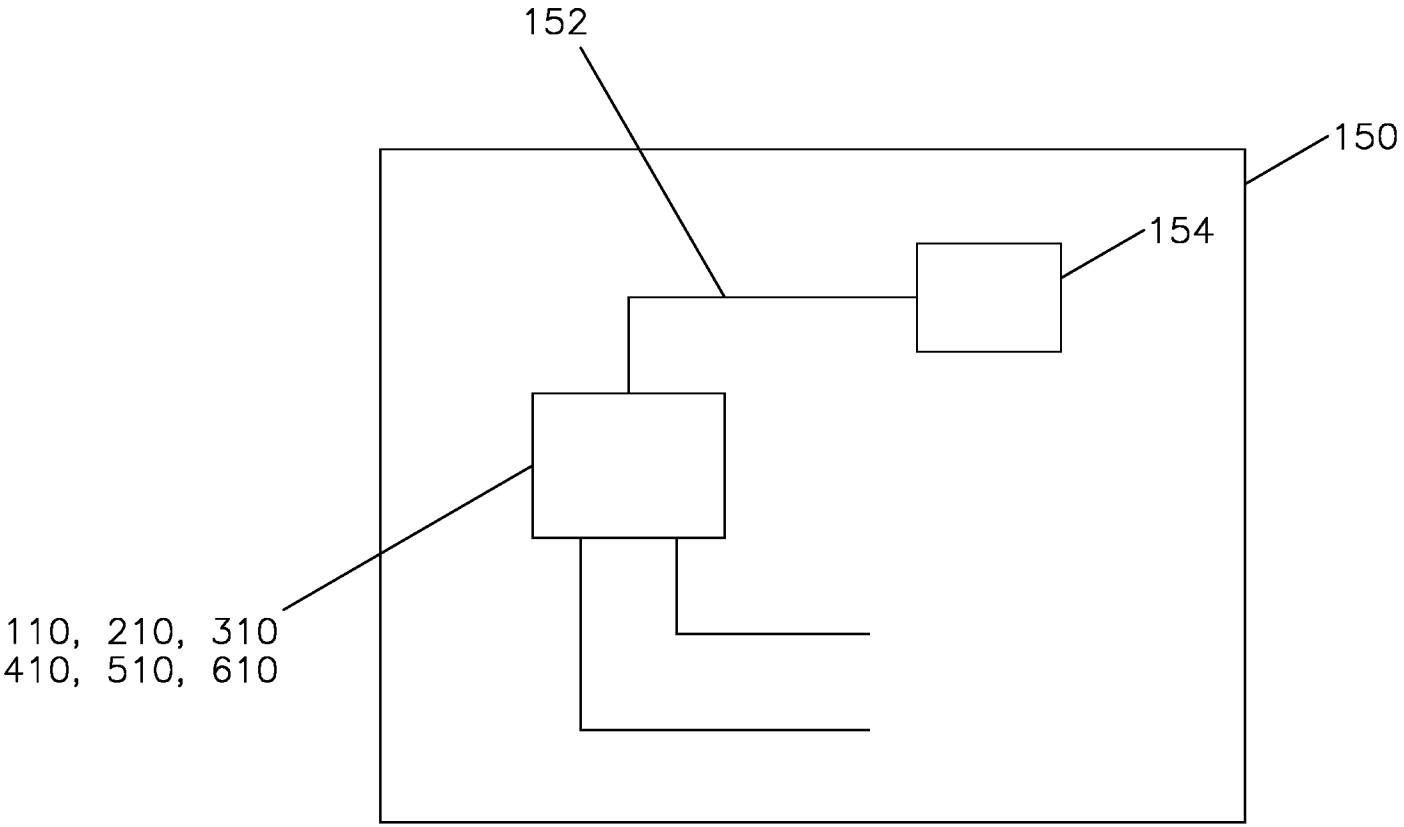
FIG. 41 is a schematical representation of a circuit assembly using an electrical assembly of one the previous figures.

Now, additionally referring to FIG. 41 there is illustrated an electrical assembly 150 having conductors 152, an electrical component 154 and a dual resolution potentiometer 110, 210, 310, 410, 510 or 610 coupled to assembly 150. The abstract nature of FIG. 41 is intentional with the nature of electrical component 154 being any type of electrical component. Conductor 152 may be electrically connected to the output of dual resolution potentiometer 110, 210, 310, 410, 510 or 610, which benefits from the fine adjustment capability of dual resolution potentiometer 110, 210, 310, 410, 510 or 610.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A dual resolution potentiometer electrically connectable to an electrical assembly, the dual resolution potentiometer including:

a first resistive element having a first adjustment mechanism; and a second resistive element having a second adjustment mechanism, said first adjustment mechanism being coupled in a hysteresis arrangement to said second adjustment mechanism, said hysteresis arrangement allows said first adjustment mechanism to not drive said second adjustment mechanism for a predefined amount when a direction in which said first adjustment mechanism is being adjusted is reversed.

2. An electrical assembly, comprising:

a conductor arrangement; and a dual resolution potentiometer electrically connected to said conductor arrangement, the dual resolution potentiometer including:

a first resistive element having a first adjustment mechanism; and a second resistive element having a second adjustment mechanism, said first adjustment mechanism being coupled in a hysteresis arrangement to said second adjustment mechanism, said first adjustment mechanism having a first resistive range, said second resistive element having a second resistive range, said first resistive range being less than said second resistive range.

3. An electrical assembly, comprising:

a conductor arrangement and a dual resolution potentiometer electrically connected to said conductor arrangement, the dual resolution potentiometer including:

a first resistive element having a first adjustment mechanism; and a second resistive element having a second adjustment mechanism, said first adjustment mechanism being coupled in a hysteresis arrangement to said second adjustment mechanism, said first adjustment mechanism being configured to drive said second adjustment mechanism when said first adjustment mechanism is positioned proximate to an end of said first resistive range.

4. An electrical assembly, comprising:

a conductor arrangement and a dual resolution potentiometer electrically connected to said conductor arrangement, the dual resolution potentiometer including:

a first resistive element having a first adjustment mechanism; and a second resistive element having a second adjustment mechanism, said first adjustment mechanism being coupled in a hysteresis arrangement to said second adjustment mechanism, said hysteresis arrangement including a predefined slop between said first adjustment mechanism and said second adjustment mechanism.

5. The electrical assembly of claim 4, wherein said slop allows said first adjustment mechanism to adjust said first resistive element through said first resistive range without adjusting said second resistive element.

6. An electrical assembly, comprising:

a conductor arrangement and a dual resolution potentiometer electrically connected to said conductor arrangement, the dual resolution potentiometer including:

a first resistive element having a first adjustment mechanism; and a second resistive element having a second adjustment mechanism, said first adjustment mechanism being coupled in a hysteresis arrangement to said second adjustment mechanism, said first adjustment mechanism having a first resistive range that extends over a first angular arc, said second resistive element having a second resistive range that extends over a second angular arc, said first angular arc being less than said second angular arc.

7. An electrical assembly, comprising:

a conductor arrangement; and a dual resolution potentiometer electrically connected to said conductor arrangement, the dual resolution potentiometer including:

a first resistive element having a first adjustment mechanism; and a second resistive element having a second adjustment mechanism, said first adjustment mechanism being coupled in a hysteresis arrangement to said second adjustment mechanism, said hysteresis arrangement allowing said first adjustment mechanism to sometimes drive said second adjustment mechanism.

8. An electrical assembly, comprising:

a conductor arrangement and a dual resolution potentiometer electrically connected to said conductor arrangement, the dual resolution potentiometer including:

a first resistive element having a first adjustment mechanism; and a second resistive element having a second adjustment mechanism, said first adjustment mechanism being coupled in a hysteresis arrangement to said second adjustment mechanism, said hysteresis arrangement allowing said first adjustment mechanism to not drive said second adjustment mechanism for a predefined amount when a direction in which said first adjustment mechanism is being adjusted is reversed.

9. A dual resolution potentiometer electrically connectable to an electrical assembly, the dual resolution potentiometer including:

a first resistive element having a first adjustment mechanism; and a second resistive element having a second adjustment mechanism, said first adjustment mechanism being coupled in a hysteresis arrangement to said second adjustment mechanism, said hysteresis arrangement allows said first adjustment mechanism to sometimes drive said second adjustment mechanism.

10. A dual resolution potentiometer electrically connectable to an electrical assembly, the dual resolution potentiometer including:

a first resistive element having a first adjustment mechanism; and a second resistive element having a second adjustment mechanism, said first adjustment mechanism being coupled in a hysteresis arrangement to said second adjustment mechanism, said first resistive element having a first resistive range, said second resistive element has a second resistive range, said first resistive range being less than said second resistive range.

11. A dual resolution potentiometer electrically connectable to an electrical assembly, the dual resolution potentiometer including:

a first resistive element having a first adjustment mechanism; and a second resistive element having a second adjustment mechanism, said first adjustment mechanism being coupled in a hysteresis arrangement to said second adjustment mechanism, said hysteresis arrangement allowing said first adjustment mechanism to drive said second adjustment mechanism when said first adjustment mechanism is positioned proximate to an end of said first resistive range.

12. A dual resolution potentiometer electrically connectable to an electrical assembly, the dual resolution potentiometer including:

a first resistive element having a first adjustment mechanism; and a second resistive element having a second adjustment mechanism, said first adjustment mechanism being coupled in a hysteresis arrangement to said second adjustment mechanism, said hysteresis arrangement includes a predefined slop between said first adjustment mechanism and said second adjustment mechanism.

13. The dual resolution potentiometer of claim 12, wherein said slop allows said first adjustment mechanism to adjust said first resistive element through said first resistive range without adjusting said second resistive element.

14. A dual resolution potentiometer electrically connectable to an electrical assembly, the dual resolution potentiometer including:

a first resistive element having a first adjustment mechanism; and a second resistive element having a second adjustment mechanism, said first adjustment mechanism being coupled in a hysteresis arrangement to said second adjustment mechanism, said first adjustment mechanism having a first resistive range that extends over a first angular arc, said second resistive element having a second resistive range that extends over a second angular arc, said first angular arc being less than said second angular arc.

* * * * *